US005752869A

United States Patent [19]

Huff

[11] Patent Number: 5,752,869

[45] Date of Patent: May 19, 1998

[54] TOY CONSTRUCTION SET

[76] Inventor: Randolph W. Huff, 227 W. 12th Street, New York, N.Y. 10014

[21] Appl. No.: 595,530

[22] Filed: Feb. 1, 1996

[51] Int. Cl.[6] ..... A63H 3/16

[52] U.S. Cl. ..... 446/104; 446/97; 446/102

[58] Field of Search ..... 446/85, 97–102, 446/104, 117, 120, 124, 125; 434/274

[56] References Cited

U.S. PATENT DOCUMENTS

| | | | |
|---|---|---|---|
| 144,124 | 10/1873 | Oberndorf, Jr. | 446/124 |
| 409,744 | 8/1889 | Garben | 446/104 |
| 1,223,508 | 4/1917 | Meyner . | |
| 2,475,306 | 7/1949 | Beder | 446/97 |
| 2,776,152 | 1/1957 | Ianuzzi | 446/85 |
| 3,458,949 | 8/1969 | Young | 446/124 |
| 3,648,404 | 3/1972 | Osgbury et al. | 446/102 |
| 3,747,261 | 7/1973 | Salem | 446/104 |
| 4,617,001 | 10/1986 | Parein | 446/102 |
| 4,838,795 | 6/1989 | Draenert | 434/274 |
| 5,486,127 | 1/1996 | Wolfe | 446/97 |
| 5,531,625 | 7/1996 | Zhong | 446/120 |

FOREIGN PATENT DOCUMENTS

| | | | |
|---|---|---|---|
| 500814 | 3/1954 | Canada | 446/102 |
| 533227 | 9/1931 | Germany | 446/97 |
| 2205524 | 8/1973 | Germany | 446/124 |
| 2260162 | 4/1993 | United Kingdom | 446/102 |
| 8303059 | 9/1983 | WIPO | 446/124 |

*Primary Examiner*—Robert A. Hafer
*Assistant Examiner*—Jeffrey D. Carlson
*Attorney, Agent, or Firm*—Lieberman & Nowak, LLP

[57] ABSTRACT

A toy construction set suitable for modeling animal, bird, insect, dinosaur and humanoid figures. The individual components of the toy construction set are analogous to bones and moveable joints. The construction set includes various sizes of limbs, heads, joints and hubs which are useable to form life like arms, legs, wings, necks, spines and tails of creatures, the variety of which is limited only by the child's imagination.

15 Claims, 4 Drawing Sheets

TOY CONSTRUCTION SET

BACKGROUND OF THE INVENTION

This invention relates to toy construction sets and specifically to toy construction sets suitable for modeling animal, bird, insect, dinosaur and humanoid figures.

Over the years many different types of toy construction sets comprising a multiplicity of parts have been produced. The parts of the set may be assembled by the child in a large variety of ways. One example of this type of construction set is "Lego" brick-like blocks which have interlocking pegs and holes and which may be assembled into large structures. Another popular construction set toy is the "Tinker-Toy" which consists of wooden rods which fit into hubs in a hub and spoke arrangement which may also be used to construct a wide variety of structures. The play value of such construction sets is greatly enhanced by the fact that the child can use his or her own imagination to construct structures in a number of different forms and thereafter reuse the components to construct something different.

A disadvantage of the above described construction sets is that the type of structure that can be built is limited by the geometry of the particular construction set. Indeed both the Lego and Tinker Toy construction sets are best suitable for the modeling of inanimate objects, such as buildings and Ferris wheels, and are not particularly suitable for the modeling of animal or humanoids because of their fixed joints. The present invention is directed to overcoming these disadvantages and to providing a toy construction set that is particularly suitable for the construction of animate objects such as animals, birds, insects, dinosaurs and humanoids (robots, monsters and people).

The present invention is directed to a construction set that is particularly adapted for the modeling of animate objects and particularly to objects having bones, joints and limbs (e.g. vertebrates). To this end the individual components of the construction set are analogous to bones and moveable joints. The construction set includes various sizes of limbs, joints and hubs which are useable to form life like necks, spines and tails of creatures whose design is limited only by the child's imagination.

BRIEF DESCRIPTION OF THE DRAWINGS

For a better understanding of the invention reference is made to the following drawings which are to be taken in conjunction with the detailed description to follow.

DETAILED DESCRIPTION OF THE PREFERRED EMBODIMENT

Figure 1:
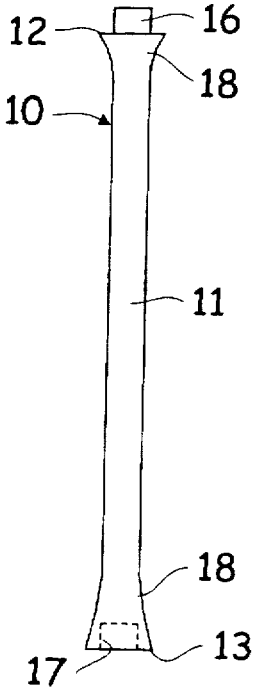
FIG. 1 is a perspective view of the long bone component of a toy construction set constructed in accordance with the present invention.

FIG. 1 illustrates the first component of the construction set of the present invention. The first component is a long bone 10 which has an elongated shaft portion 11 and end flanges 12, 13. Extending from flange 12 is a connecting post 16 and extending into flange 13 is a connecting socket 17. The portions of shaft 11 proximate to flanges 12,13 include flares 18 which provides strength and stability as well as lending an attractive bone-like appearance to shaft 11. Connecting socket 17 is designed to receive, with a friction fit, the connecting post of another component and connecting post 16 is designed to fit into the connecting sockets of the other components with a friction fit. In this manner each of the components may be joined to each other as the connecting socket and connecting post dimensions are standardized. Preferably the dimensions of the connecting posts and connecting sockets of the present construction set are the same as the connecting posts and connecting sockets of Lego blocks, so that Lego blocks and accessories can be used in conjunction with the components of the present construction set.

Figure 2:
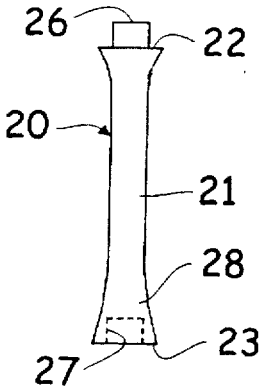
FIG. 2 is a perspective view of a short bone component of the present toy construction set.
Figure 3:
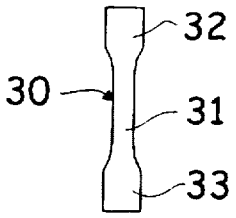
FIG. 3 is a perspective view of the small bone component of the present toy construction set.

Another component part shown in FIG. 2 is a short bone 20 which has a shaft 21 which is shorter than that of shaft 11 of bone 10. Short bone 20 includes flanges 22,23; a connecting post 26 and a connecting socket 27. Shaft 21 also has flares 28 leading to flanges 22,23. As with all of the components of the present construction set, connecting post 26 and connecting socket 27 are of the standard dimensions. A small bone 30 shown in FIG. 3 forms another bone like component. Small bone 30 includes a short, narrow shaft 31 and end portions 32,33. End portions 32,33 of small bone 30 are sized and configured to have the same dimensions as the standard connecting posts of the other components, thus end portions 32,33 can be inserted into any standard connecting socket.

Figure 4:
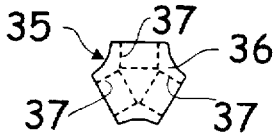
FIG. 4 is a perspective view of the small hub component of the present toy construction set.
Figure 5:
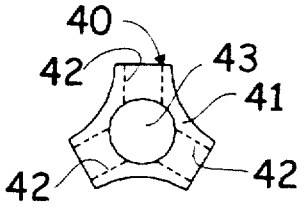
FIG. 5 is a perspective view of the large hub component of the present toy construction set.

In order to connect more than two components of the construction set together, as well as to connect components transversely, a small hub 35 shown in FIG. 4 and a large hub 40 shown in FIG. 5 are provided. Small hub 35 has a body portion 36 and three connecting sockets 37 extending radially outwardly. Connecting sockets 37 are of the standard size to receive the connecting posts of the other components. Small hub 35 may be used to provide a Y branching of the other components. Large hub 40 includes a body portion 41 and three radially extending connecting sockets 42. Body portion 41 of large hub 40 includes an opening 43 which will receive the inserts and connectors described below.

Figure 6:
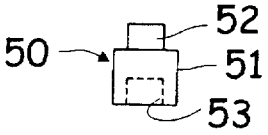
FIG. 6 is a perspective view of the insert connector component of the present toy construction set.
Figure 7:
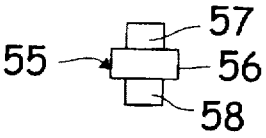
FIG. 7 is a perspective view of the male connector component of the present toy construction set.

In order to provide connections and extensions to large hub 40 an insert connector 50 shown in FIG. 6 and a male connector 55 shown in FIG. 7 are provided. Insert 50 includes a cylindrical body portion 51 which is sized to be a friction fit in opening 43 of large hub 40. Extending from the upper part of body portion 51 of insert 50 is a connecting post 52 with a connecting socket 53 disposed in the lower surface. Male connector 55 has a cylindrical body portion 56 sized to be inserted in opening 43 of large hub 40. The connecting posts 57 and 58 extend from the upper and lower flat surfaces of body portion 56 of male connector 55. Male connector 55 can also serve as a female to male gender changer. Thus by the use of inserts 50, or male connectors 55, a series of large hubs 40 may be stacked together with other components inserted into its connecting sockets 42.

Figure 8:
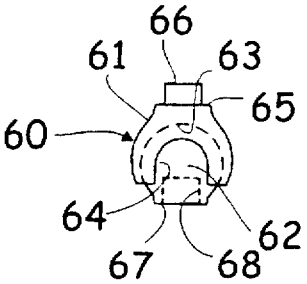
FIG. 8 is a perspective view of the large joint component of the present toy construction set.

An essential requirement for modeling a vertebrate is to provide for moveable joints, to this end the present construction set provides a number of moveable joint components. The first such component is a large joint 60 shown in FIG. 8 which includes a cup portion 61 for movably receiving a ball portion 62. Cup portion 61 includes a semi spherical concave recess 63 and U-shaped notches 64 in its forward and rearward walls. Recess 63 is designed to extend around more than half of ball portion 62 so as to retain same. This configuration also makes it difficult, if not impossible, for a child to disassemble cup portion 61 from ball portion 62. U-shaped notches 64 provide clearance to permit large pivoting angles of more than 90° between cup portion 61 and ball portion 62 and to permit cup portion 61 to "stretch" to permit ball portion 62 to be inserted during manufacturing.

A flat surface 65 on cup portion 61 forms a flange from which a connecting post 66 extends. Ball portion 62 includes a flat surface 67 which has a connecting socket 68. Thus when large joint 60 is used to join two components the components may be pivoted with respect to one another in any desired plane. In this regard flat surface 67 is sized such that it is smaller than the distance between the arms of U-shaped notches 64. Preferably one or both of the abutting surfaces of ball portion 62 and cup portion 61 are roughened to assure a good friction fit, so that the angular position set by the user will not slip due to the weight of the attached components.

Figure 9:
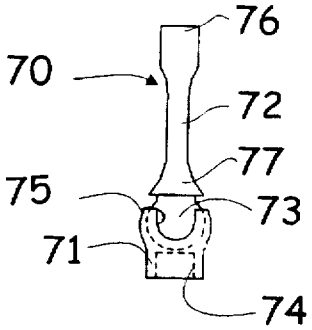
FIG. 9 is a perspective view of the small joint component of the present toy construction set.

Another joint component is a small joint 70 shown in FIG. 9 which is comprised of a small cup portion 71 and a small bone portion 72 which has at one end a small ball 73. Ball 73 and cup portion 71 are similar to, but smaller in diameter, than large joint 60. The free end of cup portion 71 includes a connecting socket 74 and has U-shape openings 75 on each side which provides clearance to permit portion 72 to be pivoted more than 90° with respect to small cup portion 71. Small bone portion 72 has a connecting post 76 at its free end and a flared section 77 at the end proximate to ball 73. As was the case with large joint 60, cup portion 71 is constructed to surround more than half of ball 73 so as to retain it and to make it difficult for a child 10 to disassemble cup portion 71 from small bone 72. The confronting ball and cup surfaces may also be roughened so as to maintain a set position.

Figure 10:
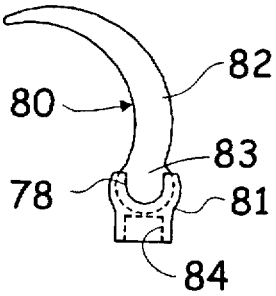
FIG. 10 is a perspective view of the claw component of the present toy construction set.

FIG. 10 shows a "clawball 80" which has a cup portion 81 and a claw portion 82 which has a ball 83 at one end. Cup portion 81 is basically the same as cup portion 71 and includes a connecting socket 84 and U-shaped openings 78 on each side which provides clearance to permit portion 82 to be pivoted more than 90°. Cup portion 81 is also constructed to surround more than half of ball 83 so as to retain it and to make it difficult for a child to disassemble.

Figure 11:
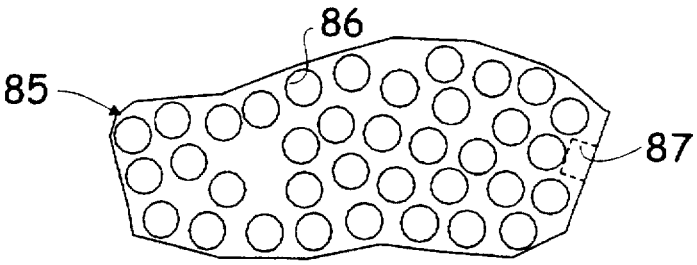
FIG. 11 is a perspective view of the head component of the present toy construction set.

FIG. 11 illustrates a toy "head" 85 which has an outer profile in the shape of an animal, dinosaur or other type of head. Head 85 includes a number of connecting sockets 86 to permit other components to be connected to it. A lateral edge of head 85 may also contain a connecting socket 87 to permit head 85 to be connected to other components forming a "neck". Rather than connecting sockets 86, connecting posts could also be used on head 85, or a mixture of posts and sockets. The head component of course need not be made in the shape shown as it could be in a wide variety of shapes to model different creatures. Furthermore plates in other geometric shapes such as circles, squares and triangles could also be used with the present construction set.

Figure 12:
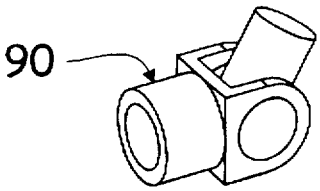
FIGS. 12 and 13 are perspective views of the pivoting connector of the present toy construction set.
Figure 13:
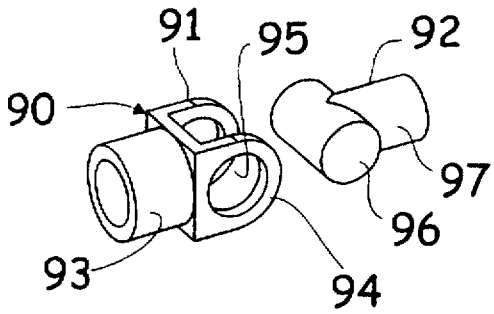

FIGS. 12 and 13 illustrate another connector 90 which is pivotable in a single plane. Connector 90 includes a yoke portion 91 and a T-shaped pivoting portion 92. Yoke portion 91 includes a connecting socket 93 and loops 94 having circular openings 95 for pivotally receiving the cylindrical top part 96 of pivoting portion 92. Pivoting portion 92 also includes a connecting post 97 for connection to other components.

Figure 14:
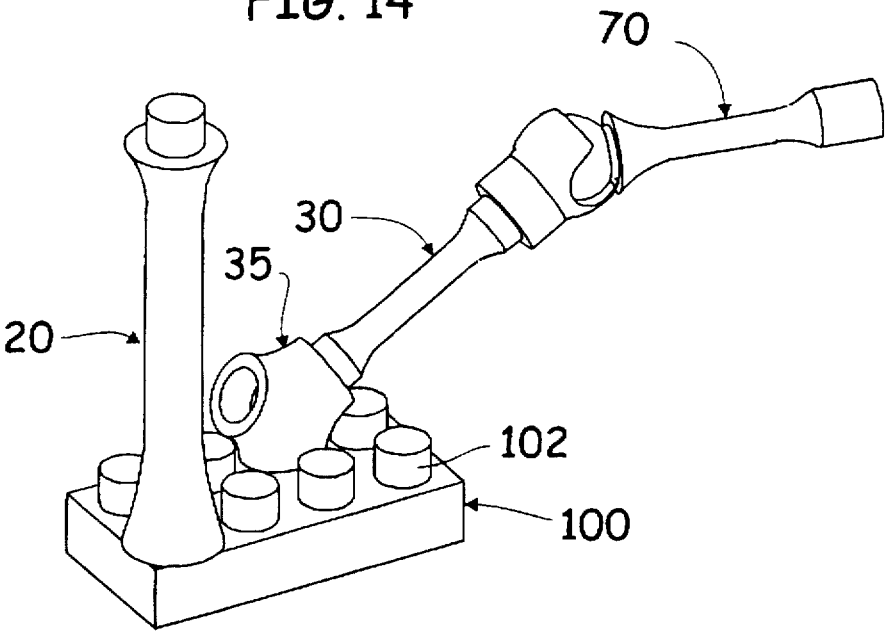
FIG. 14 is a perspective view of the components of the present toy construction set connected to a standard Lego block.

FIG. 14 shows certain of the components of the present construction set attached to a standard Lego building block 100. As can be seen the components of the present construction set which utilize connecting posts and sockets of the same diameter of the posts 102 of the Lego block 100 can directly connect to Lego pieces. In this manner Lego blocks can be used in creating the humanoid or animal figures, by way of example block 100 can form a "foot" for the figure.

Figure 15:
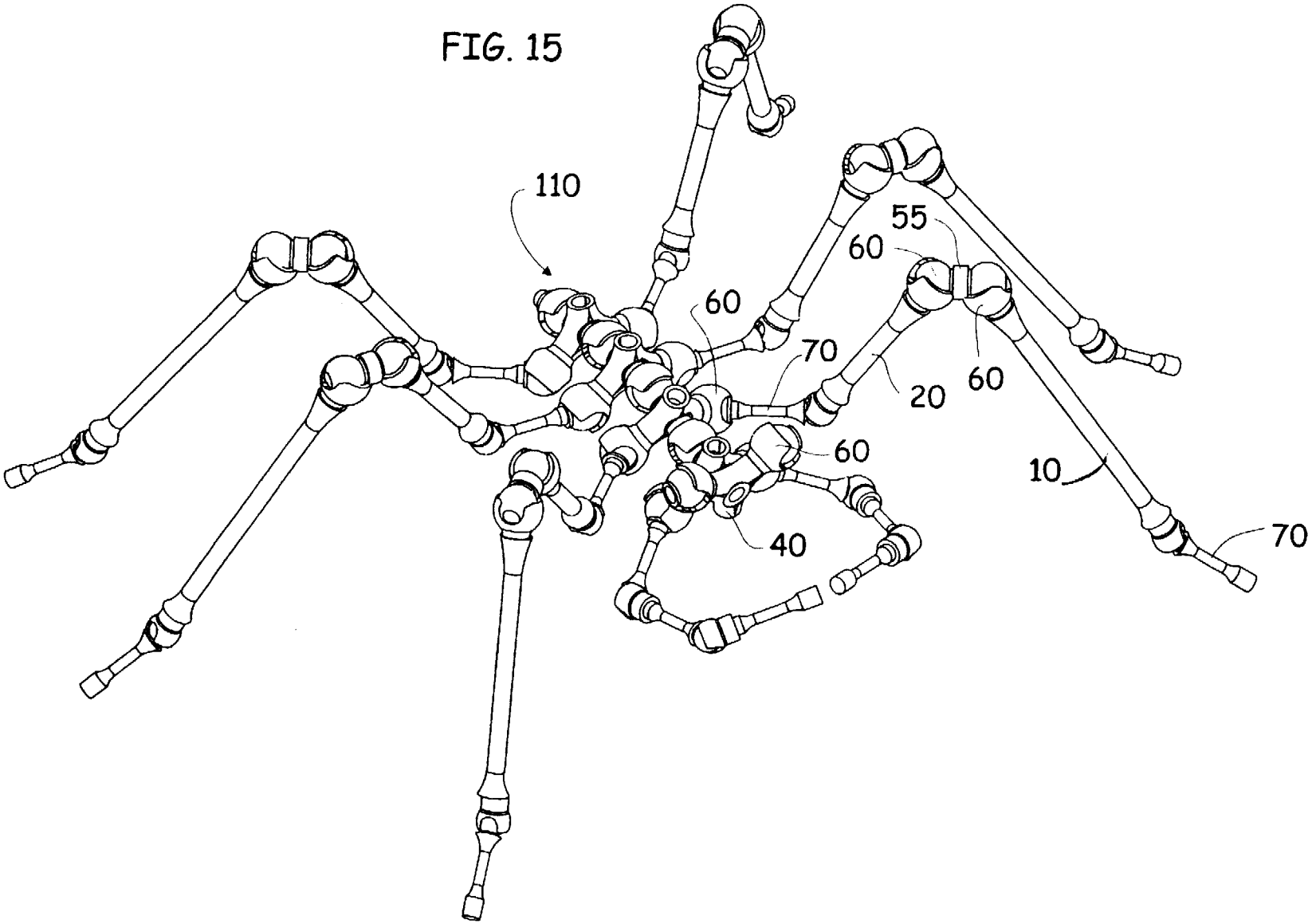
FIG. 15 is a perspective view of the components of the present toy construction set used to model an insect.
Figure 16:
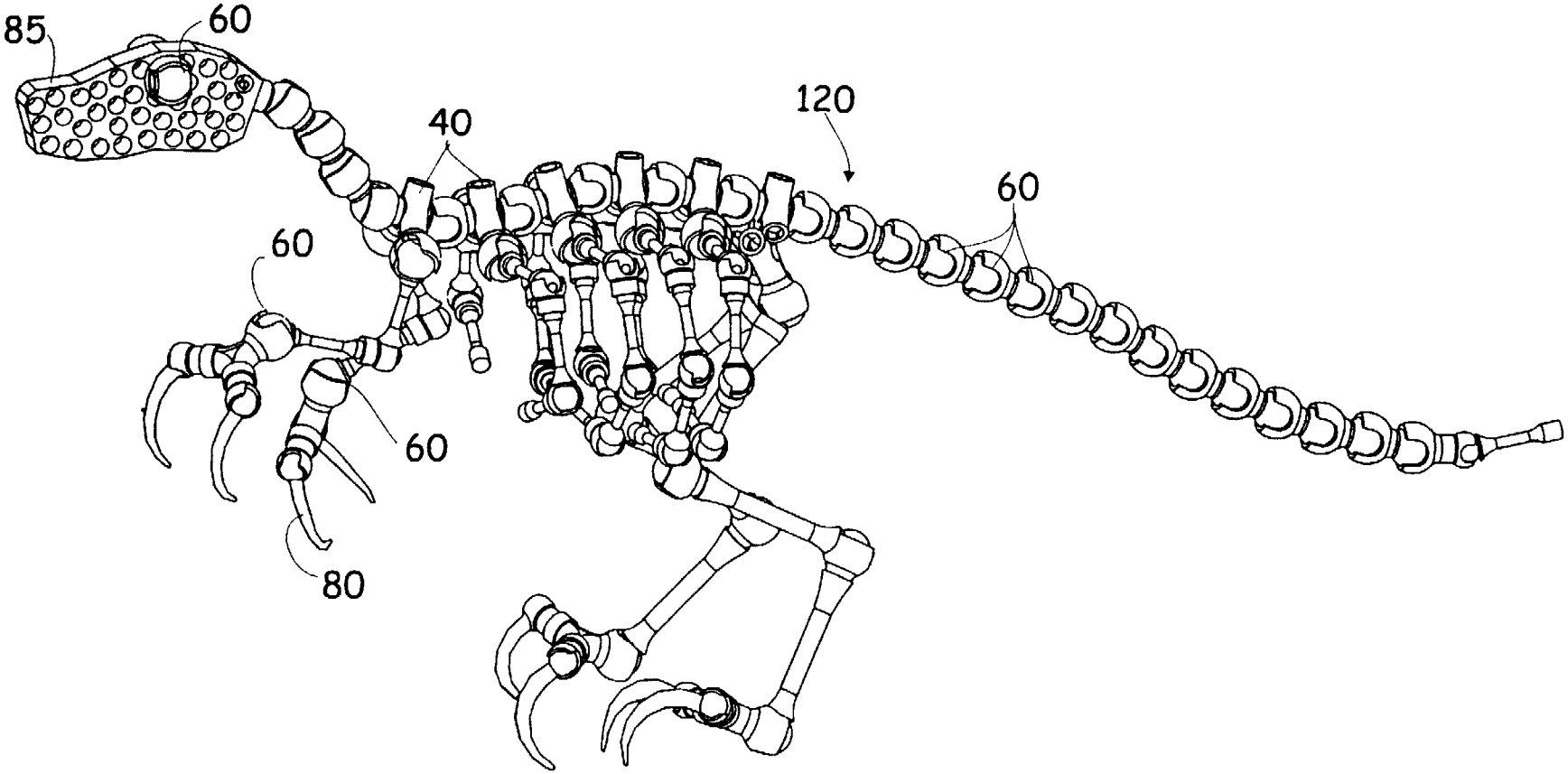
FIG. 16 is a perspective view of the components of the present toy construction set used to model a velociraptor.

FIG. 15 illustrates the above described components assembled to create a large insect like creature 110. As can be seen, the body segments of insect 110 are formed by large hubs 40 and large joints 60 with the eyes formed by large joints 60. The legs are formed from small joints 70, short bones 20, and large joints 60 joined by inserts 55. FIG. 16 shows a velociraptor 120 formed from the present construction set which utilizes head 85 and clawball 80. Velociraptor 120 illustrates how accurately a series of interconnected large joints 60 and large hubs 40 model the neck, spine and tail of the creature as they enable the modeling of life like curves.

The above described components may be made from many different types of materials. However, injection moldable relatively resilient plastics, such as polyethylene and polypropylene, are particularly suitable since they are inexpensive to manufacture. Furthermore a slight resilience also assures a good friction fit between the components. The use of resilient materials also permits to the dimension of the male components (such as connecting posts and the ball portions of joints) to be slightly larger than the female components (such as connecting sockets and the cup portions of joints). This will assure the components remain connected and in the set position while permitting removal and repositioning. Each component may also be molded in a different color to aid in assembly.

The invention has been described with respect to preferred embodiments. However, as those skilled in the art will recognize, modifications and variations in the specific details which have been described and illustrated may be resorted to without departing from the spirit and scope of the invention as defined in the appended claims.

What is claimed is:

1. A toy construction set for constructing life like figures from a plurality of releasably engageable components, comprising:

a first component in the form of a shaft having first and second ends and having connection means disposed at said first and second ends for releasible connection to another component, said first and second ends of said shaft being outwardly tapered such that they resemble biological creature-like bones;

a second component in the form of a hub unit having one or more connection means disposed radially outward from a center portion of said hub unit for releasible connection to another component, said one or more said radially disposed connection means defining a plane; said hub unit comprising a transversely disposed connection means for releasible connection to another component in a direction perpendicular to said plane;

a third component in the form of a pivotable joint, said pivotable joint having a ball portion and a cup portion, said ball portion comprising a spherical ball having connection means for releasably connecting said ball to one of said first and second components, said cup portion including connection means for connecting said cup portion to one of said first and second components and a concave recess for receiving said spherical ball, said cup portion covering more than one half of said ball when said ball is received within said cup portion to retain said ball within said recess, said cup portion including at least one notch in a side wall to permit the ball portion and the connected one of said first and second components to pivot at an angle of more than 90° with respect to said cup portion.

2. The toy construction set as claimed in claim 1 wherein said connection means provided at each said first and second ends of said first component comprises one of either a connection post and a connection socket, said radially disposed connection means of said second component comprising one of a connection post and a connection socket, said connection means of said ball portion of said third component comprising one of a connection post and a connection socket, and said connecting means of said cup portion of said third component comprising one of a connection post and a connection socket, wherein a said connection post of said first, second and third components is dimensioned such that it is a friction fit within a said connection socket of one of said first, second and third components, whereby said first, second and third components are releasably engageable with each other.

3. The toy construction set as claimed in claim 2 further including a fourth component in the form of a hub having one or more connection sockets disposed radially outwardly.

4. The toy construction set as claimed in claim 1 further including an insert component having first and second ends, wherein said transversely disposed connection means of said hub unit of said second component includes an opening for receiving said insert component, said insert component being a friction fit within said opening and having connection means in the form of one of connection posts or connection sockets disposed at each said first and second ends thereof for releasible connection with another component.

5. The toy construction set as claimed in claim 3 further comprising a fifth component in the form of a pivotable joint, said pivotable joint having a ball portion and a cup portion, said ball portion including a shaft joined at one end to said ball and having a connection means disposed at an opposite end of said shaft, said cup portion including connection means for connecting said cup portion to one of said first, second, third and fourth components and a concave recess for receiving said spherical ball, said cup portion covering more than one half of said ball when said ball is received within said cup portion to retain said ball within said recess, said cup portion including at least one notch in a side wall to permit the ball portion and the joined shaft to pivot at an angle of more than 90° with respect to said cup portion.

6. The toy construction set as claimed in claim 3 further comprising a sixth component in the form of a pivotable joint, said pivotable joint having a ball portion and a cup portion, said ball portion including a curved tapered shaft joined at one end to said ball, said cup portion including connection means for connecting said cup portion to one of said first, second, third, fourth and fifth components and a concave recess for receiving said spherical ball, said cup portion covering more than one half of said ball when said ball is received within said cup portion to retain said ball within said recess, said cup portion including at least one notch in a side wall to permit the ball portion and the joined curved tapered shaft to pivot at an angle of more than 90° with respect to said cup portion.

7. The toy construction set as claimed in claim 6 further including a seventh component having a plate in the shape of a head, said plate having at least one connection means disposed thereon for releasable connection with another component.

8. The toy construction set as claimed in claim 2 wherein a connection means of a first end of said shaft of said first component comprises a connection post and the second end of said shaft of said first component comprises a connection socket.

9. The toy construction set as claimed in claim 1 wherein a said transversely disposed connection means of said hub unit and said third component are capable of releasable connection in a repeating, alternate fashion to resemble skeletal vertebrae of a biological creature.

10. A toy construction set for constructing life like figures comprising:

a plurality of releasibly engageable components, each of the components having connection means for releasible connection to another of said releasably engageable components;

at least one of said components being in the form of a shaft having first and second ends, each end of said shaft having a said connection means disposed thereon, said first and second ends of said shaft being outwardly tapered such that they resemble biological creature-like bones;

at least one of said components being in the form of a pivotable joint, said pivotable joint having a ball portion and a cup portion, said ball portion comprising a spherical ball having connection means for connecting said ball to one of said other components, said cup portion including connection means for connecting said cup portion to one of said other components and a concave recess for receiving said spherical ball, said cup portion covering more than one half of said ball when said ball is received within said cup portion to retain said ball within said recess, said cup portion including at least one notch in a side wall to permit the ball portion and the connected first component to pivot at an angle of more than 90° with respect to said cup portion; and, at least another of said components in the form of a hub unit having one or more connection means disposed radially outward from a center portion of said hub unit for releasible connection to one of said other components, said one or more said radially disposed connection means defining a plane; said hub unit comprising a transversely disposed connection means for releasible connection to another component in a direction perpendicular to said plane.

11. The toy construction set as claimed in claim 10 wherein one of said plurality of releasibly engageable components includes an insert component having first and second ends, said transversely disposed connection means of said hub unit including an opening for receiving said insert component, said insert component being a friction fit within said opening and having connection means disposed at said first and second ends thereof for releasible connection with connection means provided on another of said plurality of components.

12. The toy construction set as claimed in claim 11 wherein said connection means comprises either one of a connection post and a connection socket, said connection post being dimensioned such that it is a friction fit within a said connection socket of another component for releasable engagement therewith.

13. The toy construction set as claimed in claim 12 wherein at least one of said plurality of releasibly engageable components comprises a hub having at least three said connection sockets disposed radially outwardly

14. The toy construction set as claimed in claim 12 wherein a connection means of a first end of said shaft comprises a connection post and the second end of said shaft comprises a connection socket.

15. The toy construction set as claimed in claim 10 wherein a said transversely disposed connection means of said hub unit and said component in the form of a pivotable joint are capable of releasable connection in a repeating, alternate fashion to resemble skeletal vertebrae of a biological creature.

* * * * *